US006579136B1

(12) United States Patent
Hahn et al.

(10) Patent No.: US 6,579,136 B1
(45) Date of Patent: Jun. 17, 2003

(54) SYSTEMS AND METHODS FOR CONTAINING AND DELIVERING PROTECTIVE MATERIALS TO RAW WATER PASSAGEWAYS WITHIN LIQUID-COOLED MARINE ENGINES

(75) Inventors: Douglas Hahn, Virginia Beach, VA (US); Mark Skrzypek, Chesapeake, VA (US); Joseph Zablocki, Brandenton, FL (US); Eric Von Hoene, Norfolk, VA (US); Robert Galway, Virginia Beach, VA (US); Carl Stone, II, Portsmouth, VA (US); Cedric Savineau, Virginia Beach, VA (US)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 09/683,333

(22) Filed: Dec. 14, 2001

(51) Int. Cl.[7] ..... B63H 21/10
(52) U.S. Cl. ..... 440/88
(58) Field of Search ..... 440/88

(56) References Cited

U.S. PATENT DOCUMENTS 3,320,964 A * 5/1967 Tripp ..... 134/100.1
5,746,629 A * 5/1998 Smith ..... 440/88
5,775,964 A * 7/1998 Clark ..... 440/88
5,871,068 A * 2/1999 Selby ..... 184/1.5

* cited by examiner

*Primary Examiner*—Jesus D. Sotelo
(74) *Attorney, Agent, or Firm*—Howrey, Simon, Arnold & White LLP

(57) ABSTRACT

System and method for protecting a cooling system of a liquid-cooled engine using a protective material. This system enables a boat operator to flush the cooling system using salt, brackish or fresh water. In one embodiment, the system includes a reservoir, a dispenser and a connection device. The reservoir is capable of containing a protective material that can include, among others properties, anticorrosive properties. The dispenser controls release of the protective material from the reservoir and can be controlled manually or through a control unit. The system is coupled with the cooling system downstream from raw water intake ports and upstream from a terminal end of the cooling system as the cooling system terminates at the exhaust port. The protective fluid can be dispensed using gravity feed or a pump.

32 Claims, 6 Drawing Sheets

SYSTEMS AND METHODS FOR CONTAINING AND DELIVERING PROTECTIVE MATERIALS TO RAW WATER PASSAGEWAYS WITHIN LIQUID-COOLED MARINE ENGINES

BACKGROUND OF THE INVENTION

1. Field of the Invention

The invention is directed generally to systems and methods for inhibiting corrosion, freezing, and other detrimental results caused by water within a cooling system of a liquid-cooled engine, and more particularly, to systems and methods for containing and delivering protective materials to raw water passageways of a cooling system in an open loop portion of a liquid-cooled marine engine.

2. Background

Combustion engines generate power by controlling multiple explosions of a combustible fuel. This process typically produces rotational motion and generates heat as a by-product, which is dissipated in various ways. Some engines dissipate the heat by-product using convection and air flow across fins and other surfaces. Other engines dissipate the excess heat generated through an exchanger using liquid, usually a water mixture. Specifically, water-based liquid is circulated through passageways located around the exterior portions of the engine proximate to the combustion chambers containing the pistons. Liquid-cooled combustion engines are typically either closed loop or open loop systems. Closed loop systems use recirculating liquids that are internally contained within the cooling system. The liquids used within a closed loop system absorbs heat generated by the engine and is cooled through a heat exchanger, such as a radiator. Open loop systems draw cooling liquids from an outside source, circulate it around the head of the engine and then discharge the heat laden water, normally back to the environment. Thus, only raw liquid is typically used within an open loop system.

Open loop liquid-cooled combustion engines are commonly used in the marine industries. Outboard engines, inboard/outboard engines, and inboard engines have all traditionally used liquid-cooled cooling system, and many marine engine designs have used open loop systems. In open loop systems, the engine draws raw water from the body of water in which the carrying vehicle is operating and circulates that raw water through the cooling system. As a result, engines cooled in such a way are subjected to water that includes contaminants and corrosive materials. For instance, when marine engines are operated in salt water marine environments, the engines circulate salt water through the cooling systems. As is well known, salt water is an extremely corrosive fluid that can severely limit engine life and efficiency.

There are also closed loop liquid-cooled marine engine designs, but they typically do not totally eliminate the risks associated with the open loop, raw water systems. These systems can be likened to those found in automobiles in which a water-based fluid is circulated through cooling channels in the combustion engine where heat is picked up, and then passed through the radiator where the heat is released to the relatively cooler air passing over the fins of the radiator. Where the marine version of the closed loop cooling design normally departs, however, is that instead of an air-exposed radiator, a heat exchanger is used which is exposed to a raw water, open loop conveyor or passageway. In this way, heat from the closed loop is transferred to the raw water at the heat exchanger. As described above, the raw water is then discharged back to the environment. Implementation of a closed loop design does not normally eliminate an open loop arrangement in a marine engine, but it does minimize and limit the exposure of the engine's components to the corrosive raw water. That being said, even closed loop cooling arrangements on marine vessels will typically have an associated open loop system that is susceptible to the corrosive effects that raw water presents and which should be minimized through flushing procedures.

The corrosive nature of salt water has been traditionally addressed by using fresh water to flush the cooling system of a marine engine after is has been used in salt or brackish water. The conventional flushing process includes circulating fresh water through the cooling passageways of the liquid-cooled engine. This process is preferably performed soon after the engine has stopped running so that the salt water will be immediately removed from the cooling system, but especially before the water has evaporated leaving salt crystals on the inside surface of the passageways of the cooling system.

A conventional process for flushing outboard engines and inboard/outboard engines is to connect a fresh water source to the raw water intake ports located on the lower units of these marine power plants. The fresh water source can be a municipal water system, a well, or other system, and can be coupled to the raw water intake ports using a flush device that is commonly referred to as "ear muffs" or "rabbit ears." The flush devices generally have a wishbone shape with form-fitting cups attached to each end of the arms of the device forming the wishbone shape of the device. The cups are made of a pliable material and are sized to cover the raw water intake ports on the lower unit. Typically, one of the cups is in fluid communication with a standard female garden hose fitting adapted to be connected to an end of a garden hose. During use, the cups are fitted over the raw water intake ports of the lower unit and a garden hose is connected to the device. The engine is flushed by first turning on the water and allowing the water to flow up to the raw water intake ports. The engine is started and allowed to run for a period of time normally ranging from about 5 to 7 minutes.

For engines equipped with thermostats within the cooling system, it is necessary to run the engine for a time period sufficient to allow the thermostat to open so that fresh water actively flows throughout the entire cooling system. Because the boat carrying the engine has often been trailered to a second location away from the body of water where it was operated, the engine is often beginning the flushing process in a "cold" state. If so, short flushing periods will be inappropriate because in the beginning of the flushing process the fresh water only has the possibility of reaching essentially as far as the thermostat, with very little flushing water flowing therebeyond until the thermostat opens.

After a successful flushing period, the engine is stopped and the water flowing into the flushing device is then shut off. The flushing device is removed and the engine is assumed ready to be stored.

The flushing device described above is only suitable for use when the boat carrying the engine is out of the water. Otherwise, if this conventional flushing device is used while the boat remains in the water and, more importantly, while the lower unit of the power plant remains in the water, it is almost certain that corrosive raw water will seep into the raw water passages before, during and after the flushing process, thereby defeating the protective flushing measures.

While this flushing device circulates fresh water throughout the cooling system of a marine engine, it does not remove all of the salt water from the cooling system. Instead, there exist areas within most cooling systems that produce eddies when water is circulated through the engine. These eddies prevent some of the salt water from being removed from the cooling system. Thus, flushing an engine does not completely protect the open loop portion of a liquid-cooled marine engine from the corrosive action of salt water. Still further, there is no guarantee that the water used in the flushing process is itself absolutely pure and free of corrosive components.

Therefore, conventional flushing procedures at best partially protect a marine engine from salt water and also requires that the boat operator actively participate in the flushing process. Specifically, the operator must take the time to place the flush device on the lower unit and run the engine for the specified time period. While this preventive maintenance increases the life of a marine engine, many boat operators fail to flush their engine for any number of reasons such as lack of energy, lack of desire, or simply forgetting after along day on the water.

In addition to the fresh water flushing procedures described above, corrosion has been addressed by mixing anticorrosive fluids with the fresh water supply before the water enters the flushing device for added protection against corrosion. In one commercially available product, a canister containing an anticorrosive agent is coupled to a garden hose in line with the flushing device. As the water flows through the canister, a predetermined amount of the anticorrosive fluid is released into the fresh water flowing through the hose. This mixture containing the anticorrosive liquid is flushed through the cooling system as described above.

While the preceding discussion has primarily focused on flushing salt water from a marine engine, the cooling system of a liquid-cooled engine must also be properly prepared before being placed in storage for any extended period of time, and especially when being stored for the winter months in geographic locales subject to freezing temperatures. In such locales, it is necessary to winterize a marine engine. Winterizing a marine engine includes circulating an antifreeze material through the cooling system in order to prevent water contained in pockets within the cooling system from freezing and possibly causing significant damage to the cooling system and engine. This fluid can be circulated in some marine engines using the flushing device described above. Other engines require that the fluid be poured into the cooling system through strategically placed ports. This process can be time consuming and painstaking, especially when winterizing a marine engine that is housed within a tight engine room not allowing easy operator access.

Thus, a need exists for methods and arrangements for flushing an open loop portion of a liquid-cooled marine engine requiring less effort than is typically required by conventional systems. In addition, a system is needed that is more convenient by enabling an operator to flush an engine sitting either out of the water or in the water. Further, a system is needed that allows an engine to be protected when a pressurized source of fresh water is not available.

SUMMARY OF INVENTION

Set forth below is a brief summary of systems and methods configured and performed according to the present invention that address the foregoing problems and which provide benefits and advantages in accordance with the purposes of the invention as embodied and broadly described herein. According to one aspect, the invention is directed to a system for dispensing a protective material within passageways of a cooling system of a liquid-cooled engine. The system can be incorporated in different arrangements that include such liquid-cooled engines, many of which are mobile vehicles such as automobiles, trucks, airplanes and marine vessels. It should be appreciated, however, that the invention may be incorporated into other liquid-cooled engines that are not vehicle based. For instance, one example that is not directly vehicular in nature, but is at least marine-industry related, is a raw water cooled power generator on an off-shore drilling rig or platform. In most of the descriptions that are provided herein of the various embodiments of the invention(s), however, marine vehicles, such as power boats are contemplated as an appropriate and exemplary carrying vehicle.

The protective material can take the form of, or include substances or agents that are typically either in a liquid state or solid state, and have anticorrosive, antifreeze, biocidal and/or other beneficial properties. The system is sized to be incorporated at the engine, possibly in the engine compartment, or mounted on the carrying vessel in such a manner that does not require that the system or its components be removed during normal operation of the engine or boat. In addition, the system is designed to use protective materials that allow a marine engine to be flushed with raw water, which may contain corrosive contaminants such as salt. Thus, this system allows a marine engine to be protected from the corrosive action of raw water without having to flush the engine with fresh water. Instead, the engine can be "flushed" with salt or brackish water.

In one embodiment, the system includes a reservoir, a dispenser and a connection device. The reservoir contains the protective material and is sized to hold an amount of the protective material equal to at least one dose for the respective engine. Preferably, the amount contained within the reservoir equals multiple doses of the protective material. Release of the protective material contained within the reservoir is controlled by the dispenser. The dispenser may be of any number of designs, such as valves, clamps and other open/close devices. The dispenser can be manually operated or controlled remotely using an actuation device. The dispenser can be located within the reservoir, along a conduit connecting the reservoir and the cooling system of a liquid-cooled engine, or within the connection device connecting the system to the cooling system. The connection device couples the system to the cooling system of a liquid-cooled engine.

Another embodiment of the invention, includes the elements described above, together with an actuation device for controlling the release of the protective material from the reservoir. The actuation device can be controlled using a switch that may advantageously be mounted proximate to the ignition switch of the engine. Locating the switch controlling the actuation device in this position allows a boat operator to flush the engine without having to leave the console or driver's position of the boat. Instead, the boat operator can control the operations for flushing the engine from the console where he or she will likely be conducting other shut down procedures.

In yet another embodiment of this invention, the system may include all of the elements described above and can further include a control unit for managing the release of the protective material. The control unit can provide many functions. For instance, the control unit can orchestrate the opening and closing of the dispenser. In addition, the control unit can stop the engine at the proper time during the flushing process. Further, the control unit can determine if the system is operating properly.

In another embodiment of this invention, the system can include all of those elements described above, but further includes additional elements. For instance, the system can include a gauge display for reading the amount of protective material contained within the reservoir. The gauge display can be mounted on the console or dashboard of the boat for easy viewing by the boat operator. In addition, the system can include a dispenser open indicator for signaling whether the dispenser is in an open position capable of releasing protective material. The system can also include an indicator device for signaling whether the protective material is flowing from the reservoir to the cooling system.

The system can be used with marine engines which include engine configurations such as those commonly referred to as outboard engines, inboard/outboard engines, and inboard engines. The system can be included in the original design of an engine and incorporated during the manufacturing and/or assembly process of the engine. In addition, the system can be sold as an aftermarket or retro-fit kit so that it can be included with an engine after the engine has been fully assembled, or even after installation of the engine on the carrying vessel.

This system can further include an injection pump incorporated within any of the embodiments described above. If the system includes a pressuring pump, the system can be coupled with the cooling system anywhere between the low-pressure raw water intake ports and the higher pressure portions of the cooling system after the water pump. Alternatively, if the system does not include an injection pump, the system can operate using a gravity feed system. If a gravity feed system is used, the system is coupled with the cooling system of the liquid-cooled engine downstream of the raw water intake ports and upstream of the water pump located within the engine where a vacuum normally exists.

This system can be used to flush a marine engine after it has been operated in fresh, salt or brackish water or to winterize an engine before it is placed in storage for an extended period of time. A method for using this system first includes determining whether the engine has an adequate source of water to cool the engine while it is running. As set forth above, this water can be fresh, salt or brackish water. The engine is then started if it is not already running and allowed to run until the engine reaches a normal operating temperature. Once the engine reaches this temperature, the thermostat opens, thereby opening the entire passageway of the cooling system. If the engine has already been running long enough for the thermostat to open, then the process described below can be implemented without delay.

The boat operator releases the treatment into the cooling system by actuating the dispenser manually or by using a switch or similar type input. The engine is allowed to continue running for a predetermined time period approximately corresponding to the amount of time required to circulate liquid from the raw water intake port(s), through the entire cooling system and on to the terminal end of the cooling system where the liquid exits the power plant. At the expiration of this time period, the engine is stopped at the direction of the user or the control unit. The dispenser is then closed to prevent additional release of protective material. Closing the dispenser can also be completed manually or at the direction of the control unit.

An advantage of this invention is that the system can flush a liquid-cooled marine engine using fresh, salt or brackish water. Thus, a boat operator can flush the engine immediately after operating the engine in salt or brackish water. This is advantageous for a number of reasons. For instance, it is important to flush an engine operated in brackish or salt water before the water within the cooling system evaporates and leaves salt deposits that corrode the passageways of the cooling system. In addition, by enabling a boat operator to flush the engine immediately after the boat has been docked, the boat operator is less likely to forget to flush the engine.

Another advantage of this invention is that the system can flush a liquid-cooled marine engine without a pressurized fresh water source, such as a municipal water source. Therefore, this system can be used to flush an engine while the boat rests in water anywhere. This is advantageous for any boat operator and especially those who use marine engines in harsh salt environments away from municipal utilities, and in other remote locations.

Yet another advantage of this invention is that flushing the engine with protective materials or agents provides the engine with greater protection than if the engine were flushed with water alone. Thus, this system offers greater engine protection with less effort than conventional systems.

Still another advantage of this invention is that it enables a boat operator to flush an engine with a system that is already installed. The boat operator is not required to install a flushing device to accomplish the flushing procedure, as is required to flush an engine using conventional systems. Thus, this invention makes flushing an engine easier and more effective than using conventional systems.

BRIEF DESCRIPTION OF THE DRAWINGS

The accompanying drawings, which are incorporated in, and form a part of the specification, illustrate preferred embodiments of the presently disclosed invention(s) and, together with the description, disclose the principles of the invention(s). These several illustrative figures include the following.

DETAILED DESCRIPTION

This invention includes systems and methods for containing and delivering a protective material to passageways forming a cooling system of an open loop liquid-cooled engine, and more particularly, a marine engine. These systems and methods are capable of being coupled to a cooling system in a manner permitting the engine to be operated without having to remove the systems. Instead, the systems can be left in place during operation of the engine and the boat to which the engine is attached. These systems and methods can be implemented during construction of a boat or an engine, or can be installed within ah engine or boat as an aftermarket item or retro-fit kit.

Figure 1:
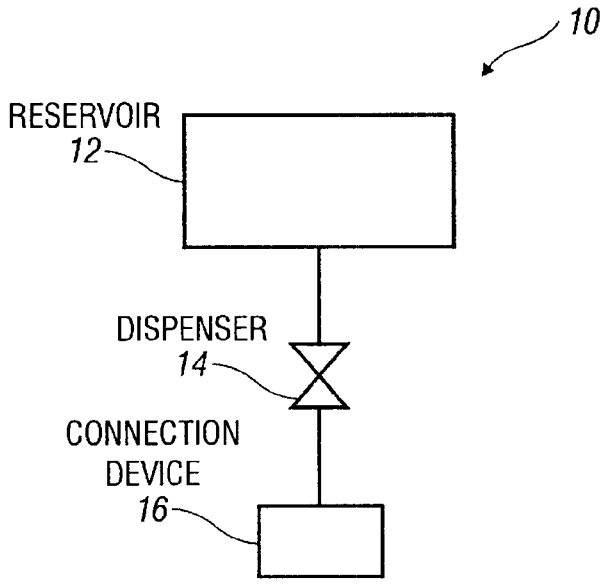
FIG. 1 is a schematic drawing of an exemplary embodiment representing primary components of this invention.

FIG. 1 schematically shows a protective material dispensing system 10 configured according to one embodiment of the invention and which includes a reservoir 12, a dispenser 14 and a connection device 16. Reservoir 12, as depicted substantially pictorially in FIG. 5, can be made to be of any appropriate size and shape capable of receiving and containing a protective material for delivery to the cooling system of a marine engine 18. In one practical embodiment, reservoir 12 can have a capacity within the range of about one to about five quarts. Further, reservoir 12 can be formed of any appropriate material of construction. Preferably, the material composing reservoir 12 is one that does not chemically react with the protective material contained therein. Such materials can include, aluminum, stainless steel, and plastics, such as, but not limited to polyolefin, polypropylene, polyethylene, and polyvinyl acetate. In one embodiment, the material composing reservoir 12 is transparent, or at least translucent, thereby allowing the level or amount of the protective material contained therein to be monitored by visually observing the top surface of the protective material through the side walls of the reservoir.

Figure 5:
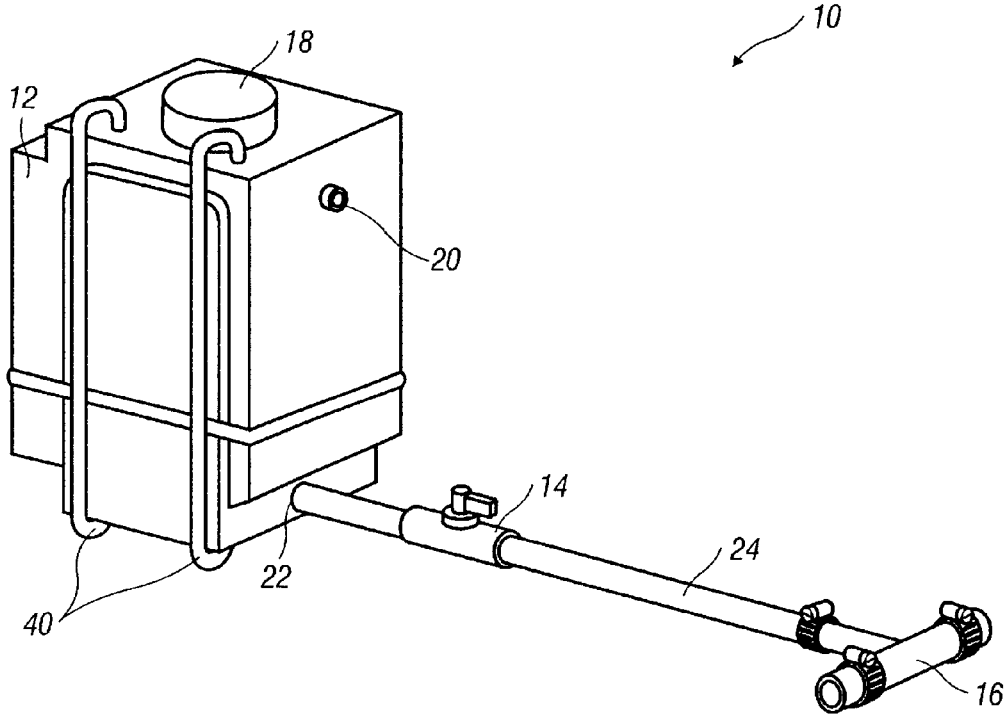
FIG. 5 is a perspective view of the exemplary embodiment of this invention schematically represented in FIG. 1.

In addition, reservoir 12 can contain calibration marks at various locations so that the amount of protective material contained within reservoir 12 can be more precisely read. Reservoir 12 preferably includes a removable lid 18 or other closure arrangement that permits access to add more protective material, but that when closed, prevents spillage of the material. Reservoir 12, however, is not required to have a lid 18. In addition, reservoir 12 can include a vent 20 to account for changes in atmospheric pressure and to otherwise release pressures, both positive and negative, that occur therein. Vent 20 can be positioned as shown in FIG. 5, or can be located elsewhere, such as on lid 18. Reservoir 12 includes a port 22 for coupling reservoir 12 with a cooling system of a liquid-cooled engine 18. Port 22 can be made of any appropriate size and shape. In one embodiment, port 22 can have a diameter within a range that is between about one quarter inch and about 1 inch. However, port 22 is not limited to this range.

Dispenser 14 controls the release of protective materials from reservoir 12. Dispenser 14 can be formed according to many different designs. For instance, dispenser 14 can be a valve, such as, but not limited to, a globe valve, a gate valve, a ball valve or other suitable open-and-close member. Alternatively, dispenser 14 can be a clamp or other device capable of preventing flow while also being capable of allowing flow to occur, such as by removing the device, rotating the device, or moving a portion of the device. Such a clamp can take the form of a hose clamp, a scissor clamp or other suitable clamp design.

In one embodiment, and as shown in FIG. 5, dispenser 14 can be coupled to reservoir 12 through a conduit 24. In another embodiment, dispenser 14 can be incorporated within reservoir 12 so that conduit 24 coupled between reservoir 12 and dispenser 14 is not needed. Conduit 24 can be made of any appropriate material. For instance, conduit 24 can be formed from a rigid material such as, but not limited to copper, aluminum, or stainless steel. Alternatively, the conduit 24 may be constructed from pliable material such as rubber, silicone, or flexible plastic.

Connection device 16 fluidly couples reservoir 12 and dispenser 14 to a cooling system of an open loop liquid-cooled engine 18. Connection device 16 can be formed of numerous designs. For instance, connection device 16 can be composed of a fitting. In one embodiment, this fitting has a T-shape as shown in FIG. 5. This fitting can be coupled to conduit 24 and the cooling system in numerous ways such as, but not limited to, solder, adhesives, compression fittings, interference fits, hose clamps as shown in FIG. 5, threads, o-rings, ribs, and concentric ribs.

In another embodiment, connection device 16 can be an inline fitting capable of being attached to the cooling system using mechanisms such as, but not limited to, solder, compression fittings, interference fittings, adhesives, threads, ribs, and o-rings. In its simplest form, connection device 16 can be an end of conduit 24 that is capable of being coupled with the cooling system. For instance, the cooling system can have a port sized to receive conduit 24.

Figure 2:
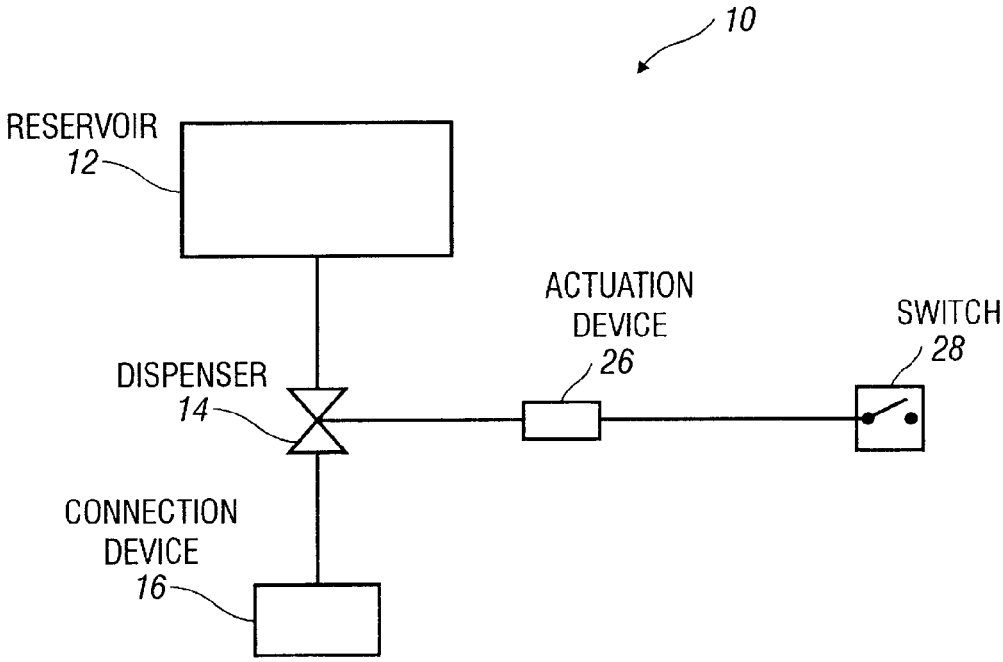
FIG. 2 is a schematic drawing of another exemplary embodiment of this invention that includes an actuation arrangement.
Figure 6:
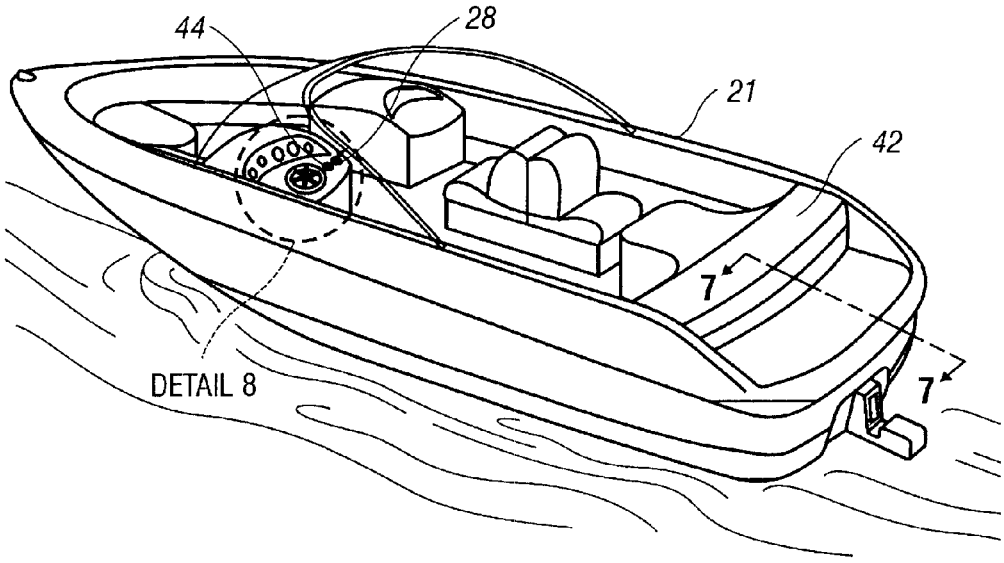
FIG. 6 is a perspective view of one type of motor boat that may include this invention.

As shown schematically in FIG. 2, another exemplary embodiment of this invention includes the elements of the embodiment shown schematically in FIG. 1, and further includes an actuation device 26 and a switch 28. The actuation device 26 is coupled to fluid connection device 16 for controlling the release of the protective material. Actuation device 26 can be a solenoid, a motor or other type of device. The motor can be coupled directly to dispenser 14, coupled to a gear for actuating the dispenser, or coupled to dispenser 14 in other suitable ways. Switch 28 can be used to release fluids from reservoir 12 by activating switch 28, which in turn causes actuation device 26 to open dispenser 14, thereby releasing the protective material. Switch 28 can be composed of switches such as, but not limited to, a toggle switch, a momentary switch, or a depressible switch, such as a button. Switch 28 can be positioned in numerous locations throughout the carrying vessel. Preferably, switch 28 is positioned proximate to the ignition key 44, as shown in FIG. 6, and in greater detail in FIG. 8. Switch 28, however, can be positioned proximate to reservoir 12 or at any other location about the vessel.

Figure 3:
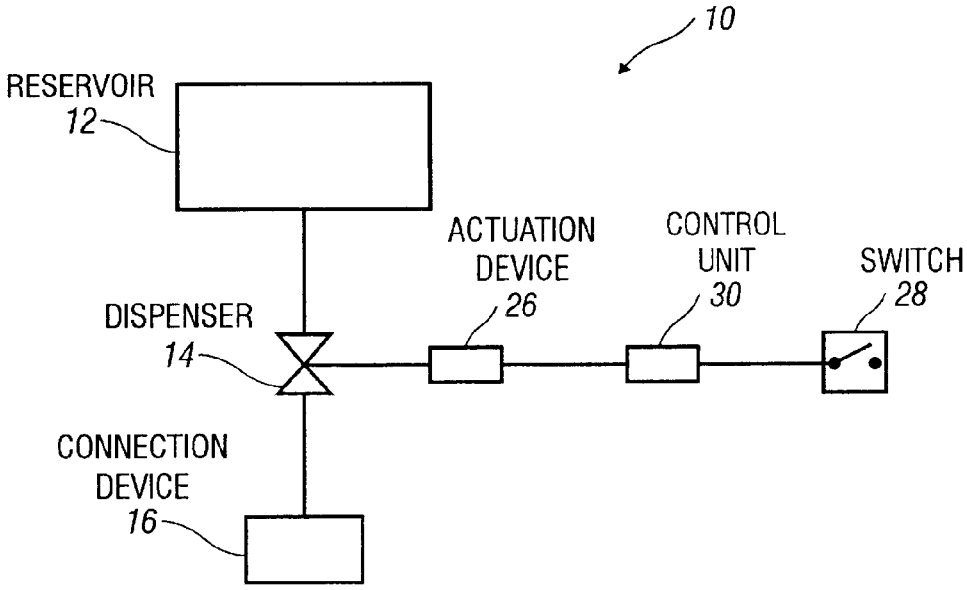
FIG. 3 is a schematic drawing of another exemplary embodiment of this invention further representing a control unit.

As shown schematically in FIG. 3, another exemplary embodiment of the invention includes the elements of the embodiments shown in FIGS. 1 and 2 and further incorporates a control unit 30. Control unit 30 can be used to accomplish numerous tasks. For instance, control unit 30 can be used to release the protective material from reservoir 12 for a predetermined period of time through use of a timing device. Once the predetermined time period expires, control unit 30 stops release of the protective material and returns dispenser 14 to a closed state. Control unit 30 is preferably positioned in a location where it is not susceptible to being damaged by rain, sunlight, or salt spray.

Figure 4:
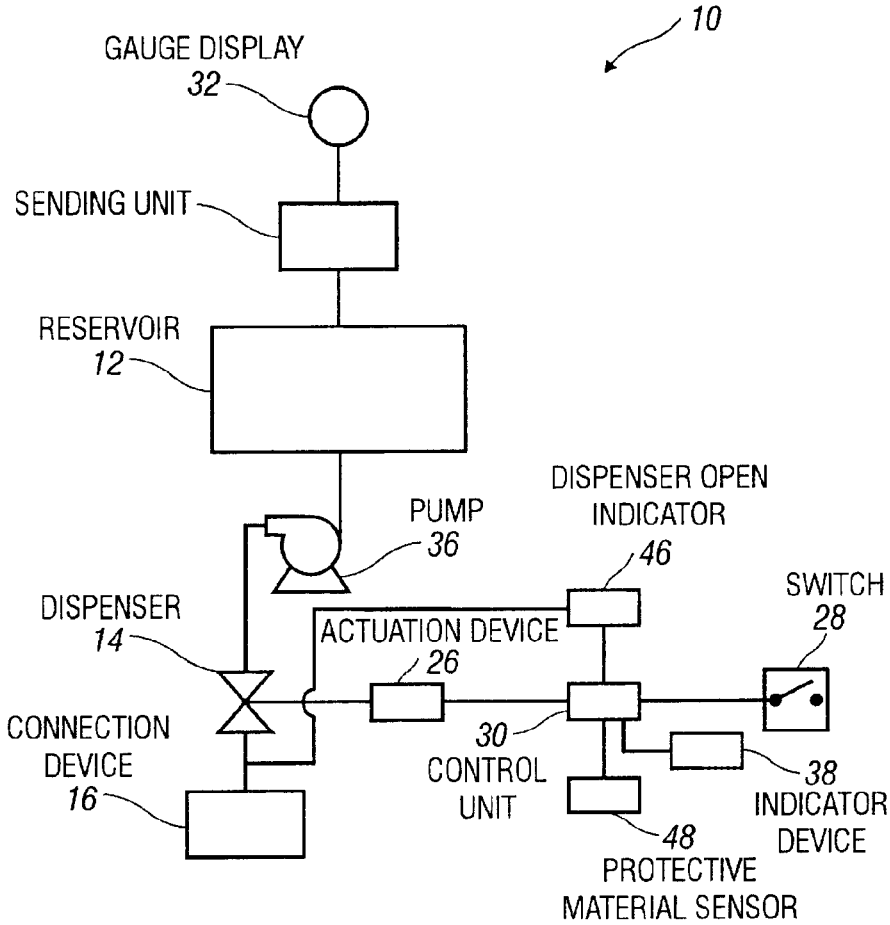
FIG. 4 is a schematic drawing of another exemplary embodiment of this invention showing additional sensor and display components.

As shown schematically in FIG. 4, another exemplary embodiment of this invention includes the elements described above, together with a collection of additional items or components. As an example, gauge display 32 is shown as part of the system 10 which is capable of displaying the level of protective material contained within reservoir 12. Gauge display 32 can include features such as, but not limited to, a digital or analog display, or both. In one embodiment, gauge display 32 is located on the console of boat 21 for easy viewing by the boat operator. Alternatively, gauge display 32 can be positioned on lid 12 or otherwise coupled with reservoir 12. A sending unit is coupled to gauge display 32 and is capable of determining the capacity of protective material located within reservoir 12 and conveying that information to gauge display 32. The sending unit can be mechanical, electrical or electro-mechanical in design. The gauge may also take the form of a warning light that only illuminates when a threshold lower level has been exceeded. Of course, the signal may be audible or otherwise attention attractive.

This embodiment, and those embodiments shown in FIGS. 1 through 3, can include a pump 36. Pump 36 can be coupled to the system 10 between reservoir 12 and dispenser 14, between the dispenser 14 and the cooling system, within reservoir 12, or within dispenser 14. Essentially, pump 36 can be located anywhere within system 10 so that the protective material contained within reservoir 12 can be pumped into the cooling system of a liquid-cooled engine 18. Typically a pump 36 will be employed when the protective material is stored in a liquid form. If the protective material or agent is reservoired in a solid state, the pump 36 may take the form of other suitable metering devices capable of handling solids.

Figure 8:
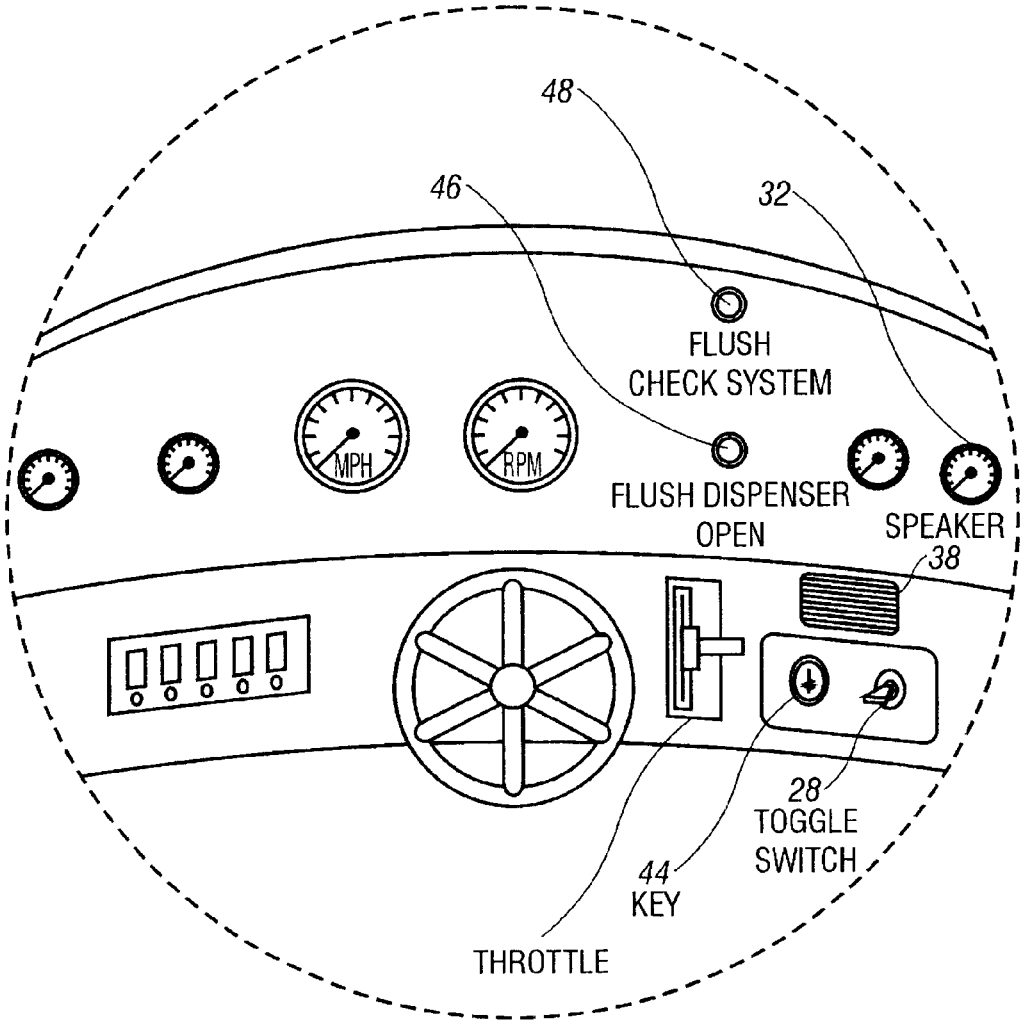
FIG. 8 is a detailed view of the console or dashboard of the boat, as indicated in FIG. 6.

The embodiment schematically represented in FIG. 4 also includes an indicator device 38 for alerting a boat operator that dispenser 14 is open and capable of releasing the protective material from reservoir 12. Indicator device 38 includes a sending unit that can be positioned within dispenser 14, conduit 24 or connection device 16. The sending unit can determine flow rate and temperature, if desired. Indicator device 38 can produce an audible alert, a visual alert, or both. For instance, indicator device 38 can include, but is not limited to, a light emitting device (LED), a speaker, as shown in FIG. 8, a gauge, or any combination of these types of devices. Indicator device 38 is preferably located proximate the driving console or seat so that the operator of the boat 21 is most likely to see or hear the indicator device 38 at the relevant time periods. That is, when operating properly, the notice will be displayed during the flushing process when the protective material is being dispensed. If there is a malfunction, however, and the dispenser inappropriately opens, then the device 38 will alert the operator to that fact.

In addition, the embodiment shown schematically in FIG. 4 can include a protective material sensor 48 for determining whether the protective material is being released into the cooling system. For instance, once a boat operator has actuated switch 28, protective material sensor 48 determines whether any protective material is actually being released into the cooling system. The sensor can be coupled to indicator device 38 to alert the boat operator that fluid is not being released from reservoir 12 into the cooling system. If the sensor produces a sound, the sound should not resemble the sound produced by the engine hot horn, which signals that the engine 17 is overheating. Instead, the sound should be easily distinguishable from the sound made by the hot horn so that a boat operator does not confuse the sounds.

FIG. 5 shows an exemplary perspective view of an embodiment of the protective material dispensing system 10 that is shown schematically in FIG. 1. The illustrated dispensing system 10 includes the reservoir 12, the dispenser 14 which is shown in the form of a valve, and the connection device 16 that is shown in the form of a T-shaped fitting. In addition, an attachment device 40 is included that enables reservoir 12 to be mounted upon boat or vessel 21, potentially even in an engine compartment 42. Attachment device 40 can be composed of many designs, such as the cradle shown in FIG. 5, that can either be permanently or releasably attached to reservoir 12 so that reservoir 12 can be removed if necessary for replacement, maintenance and the like. Attachment device 40 can also be formed from flanges incorporated within the exterior surface of reservoir 12 that are capable of receiving bolts or screws. Importantly, the installation of the reservoir can be essentially permanent upon the vessel unless a specific need arises to remove the system 10, or the reservoir 12 as a component thereof. In another embodiment, reservoir 12 can be included as an integral part of the engine rather than being a separate component that is merely placed in communication with the cooling system of the engine.

Protective material dispensing system 10 can be sized and positioned to be installed with many different styles and designs of open loop portions of liquid-cooled engines. System 10 can be installed in marine engines including, but not limited to, outboard engines, inboard/outboard engines, inboard engines and engines used in personal watercraft. Personal watercraft should be understood to include those smaller crafts that often use jet drives and typically carry one or two persons. Popular commercial embodiments of such personal water craft are marketed under the trademarks JET SKI and WAVE RUNNER.

Figure 7:
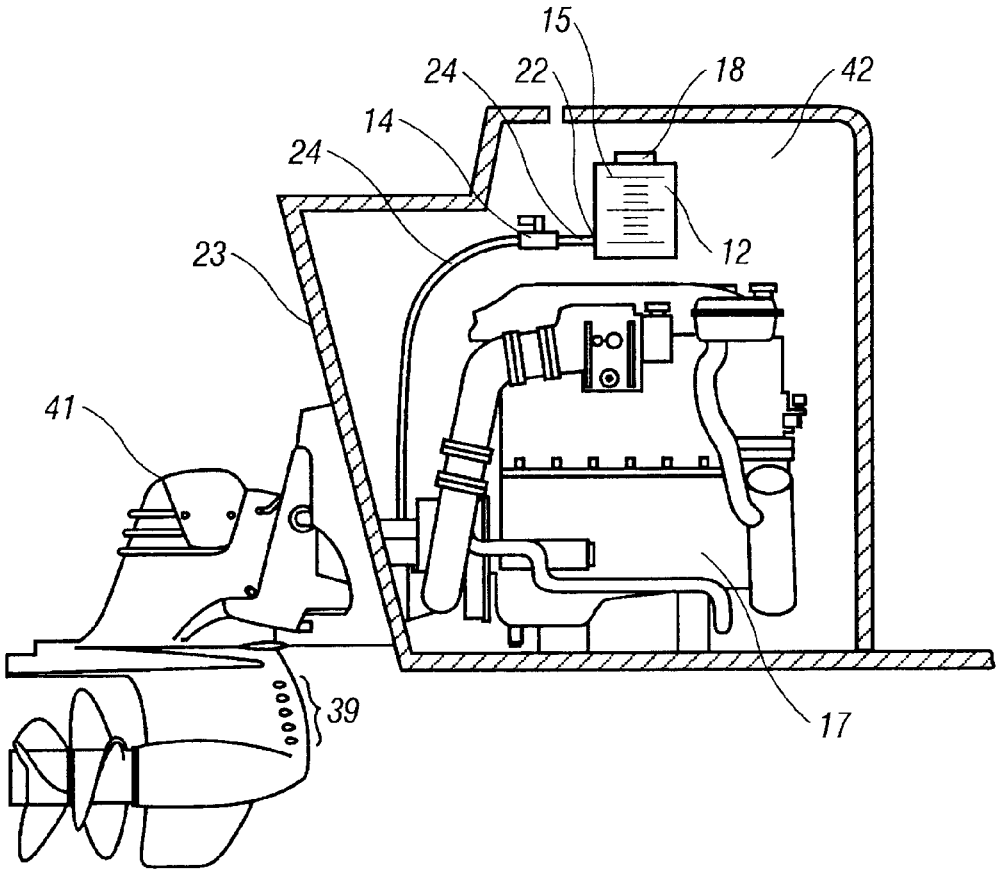
FIG. 7 is a partial cutaway view taken along line 7—7 as shown in FIG. 6.

The protective material dispensing system 10 indicated at least in FIGS. 6 and 7 is appropriately sized and configured to be installed upon a boat 21 that is powered by an inboard/outboard marine power plant. System 10 can be installed in many ways that enable it to deliver a protective material to the cooling system of a liquid-cooled engine. For instance, reservoir 12, dispenser 14 and connection device 16 can be included within an engine compartment 42. These components are not, however, required to be installed within this area of boat 21. Instead, reservoir 12 and dispenser 14 can be positioned on the deck of boat 21, against an inside surface of a side of boat 21, within a storage compartment, under the console of boat 21, and in many other locations, only limited by the requirement that the reservoir 12 and dispenser 14 be capable of being placed in fluid communication with the cooling system of the engine 18. Reservoir 12 is preferably positioned so that it can be easily filled with protective material. Alternatively, reservoir 12 can be coupled to a surface of boat 21 using a conventional flush mount fill cap assembly, much like a built-in fuel tank.

Reservoir 12 can be attached to a surface within engine compartment 42. If pump 36 is not used, reservoir 12 is positioned so that port 22 is higher than the point at which conduit 24 connects to the cooling system. This allows the protective material to drain into the cooling system using gravity, thus, forming a gravity feed. Alternatively, if pump 36 is included within system 10, the vertical position of port 22 can be higher than, equal to, or lower than the point at which conduit 24 connects to the cooling system.

Protective material dispensing system 10 can be coupled with the cooling system of engine 17 at various points along the cooling system. For instance, system 10 can be coupled to the cooling system within a lower or upper unit of the drive 41, a conduit flowing between the upper unit and engine 17, at the engine block, and at other engine components, for instance, at risers, manifolds, hoses, a thermostat housing, access ports and any other place along the length of the cooling system passageway suitable for accepting such a connection. Preferably, system 10 is coupled to the cooling system within close proximity to the raw water intake ports 39 so that protective material can be dispensed through a large portion of the cooling system. Embodiments of system 10 not including pump 36 are coupled to the cooling system upstream of the water pump that pushes and pulls raw water through the cooling passageways. For instance, as shown in FIG. 7, system 10 can be coupled to an inboard/outboard engine at the coolant-conveying hose that is located downstream of transom 23 of boat 21 and upstream of the water pump that is located substantially within the inboard/outboard engine. Embodiments of system 10 including pump 36 can be coupled to the cooling system at any location along the passageways of the cooling system.

Protective material dispensing system 10 is installed on an outboard engine in a manner somewhat similar to the illustrated configuration of system 10 shown in association with an inboard/outboard engine. Specifically, reservoir 12 can be located in numerous positions. For instance, reservoir 12 can be positioned within an engine cowling of an outboard engine. Alternatively, reservoir 22 can be located within the boat and be coupled to the cooling system of the outboard engine though a flexible hose routed, for instance, through the opening in the engine housing through which throttle cables, shift cables, battery leads and other cables are conventionally positioned. System 10 can be a gravity feed system or pressure-fed system powered by an injection pump 36.

These embodiments of the protective material dispensing system 10 are capable of distributing protective materials to the cooling system of a liquid-cooled engine while the engine 17 is running. The protective material can be a liquid, a gas, or a solid material. Further, the protective material will normally include anticorrosive properties for reducing or eliminating corrosion within the components through which the raw water flows. But one example of a suitable anticorrosive material that can be utilized is sold by Salt-Away of Newport Beach, California under the trademark, SALT-AWAY. Additionally, the protective material can have antifreeze properties for reducing the threshold temperature at which the water and other liquids contained within the cooling system freeze. Another type of protective material or agent includes biocides which may be advantageously injected, and which will likely at least partially seep out of the cooling passageway and prevent growths at the raw water inlet ports. Singularly and/or collectively these and other types of protective materials are also referred to herein as protective substances and protective agents. In a broad sense, this terminology refers to any additive that benefits an engine when imparted to the engine as part of a shut down procedure of that engine.

The protective material dispensing system 10 is capable of being used in many ways. For instance, in one scenario, the protective system 10 is capable of being used to flush the cooling system of a liquid-cooled marine engine after it has been run in salt water. This process can be performed using conventional rabbit ears to supply fresh water from a pressurized water source or by running engine 17 in the water in which the carrying vessel 21 rests. Illustratively, an anticorrosive material can be mixed with incoming raw salt water, and that mixture can be used to flush engine 21 because the anticorrosive material is capable of prohibiting the corrosive action of salt even though it is present within the cooling system. In another situation, system 10 can be used to winterize the cooling system in preparation for storage in locales subject to freezing temperatures using antifreeze.

Generally, system 10 is used by flushing engine 21 with water drawn into the cooling system through the raw water intake ports 39. It is advantageous to flush an engine that has been run in salt water as soon as possible after it has been stopped, and most advantageously, immediately before it is stopped. Thus, system 10 is generally used before stopping engine 17 for the last time after docking the boat at the end of a day or placing it in dry storage or on a trailer. Flushing engine 17 in this manner is also advantageous because when a boat returns to the dock after having been run at standard operating temperature, the thermostat within the engine 17 is still open. Thus, the entire passageway of the cooling system is open and in a condition to accept the protective material throughout the length of the cooling system.

It is preferable to begin the flushing process by first ensuring that an adequate supply of fresh water is being supplied to the cooling system. The raw water supplied can be fresh water or salt water. Thus, if the engine is attached to a boat that is sitting in water, this flushing process can be completed without additional steps needed to supply the engine with source water. If the engine is not sitting in a body of water, cooling water must be supplied. For instance, fresh water can be supplied using rabbit ears coupled over raw water intake ports 39 located on the lower unit of an inboard/outboard engine or an outboard engine. Alternatively, water can be supplied to engines using only a garden hose when those engine include flush systems composed of standard female hose fittings coupled to their cooling systems.

Once it is determined that an adequate supply of water is being provided to engine 17, the engine 17 is either started or allowed to remain running if already running, such as when the boat has just been docked and is still resting in the water. If engine 17 was already running, the dispenser 14 is actuated to release the protective material from reservoir 12. Otherwise, if engine 17 is not running, engine 17 should be started and allowed to run for about five to seven minutes, or other appropriate time period that allows the engine block to heat up to a normal operating temperature. Once engine 17 is operating within its normal temperature range, the thermostat located within the cooling system will be open and will allow cooling fluids to flow through the entire cooling system. At the expiration of this engine-warming time period, dispenser 14 is actuated to release the protective material from reservoir 12.

Actuation of dispenser 14 can be accomplished in different ways. If the embodiment shown pictorially in FIG. 5 and schematically in FIG. 1 is used, the boat operator actuates dispenser 14 by either manually opening a valve, removing a clamp or otherwise transitioning dispenser 14 to an open configuration. The protective material then feeds by gravity into the cooling system and mixes with the water that is passing through the cooling system. The protective material is released for a predetermined period of time. This predetermined time period is calculated to be approximately the time that it takes for the protective material to flow from the point at which enters the cooling system to the point at which the cooling system terminates, usually at an exhaust port. For most engines, this time period is within a range spanning from about fifteen seconds to about one minute. Once this predetermined time period has expired, engine 17 is stopped and the dispenser 14 is closed to prevent the release of any more protective material.

In the embodiment shown schematically in FIG. 2, an operator can actuate release of the protective material using switch 28 that controls the opening and closing of dispenser 14. As described above, switch 28 is preferably located proximate to ignition key 44, thereby enabling the operator to flush engine 17 without ever having to leave the console of the boat 21. In this embodiment, switch 28 preferable is a momentary switch 28 that only releases protective material when the boat operator holds switch 28 in an activated position. Once the operator allows or causes switch 28 to return to its original position, the release of protective material ceases. Alternatively, switch 28 can be an ordinary switch that allows an operator to actuate switch 28, thereby releasing the protective material until the operator actuates the switch a second time to close dispenser 14 which prevents any additional release of the protective material.

Using the embodiment shown schematically in FIG. 3, an operator can actuate the release of protective material in the same ways described above for using the embodiment shown schematically in FIG. 2. However, control unit 30 can greatly simplify the process for the boat operator. For instance, once a boat operator actuates switch 28, causing the release of the protective material, the control unit trips a timer set for a predetermined period of time. Once the period of time expires, control unit 30 stops engine 17 from running and then stops the release of the protective material by actuating dispenser 14. Therefore, the boat operator can flush engine 17 by simply actuating switch 28. Control unit 30 controls all of the additional steps. In other words, after a boat operator has docked the boat 21 after a day on the water, the operator only has to actuate one switch to initiate the flushing process and shut off the engine 18. The time periods are engine-dependent. Therefore, most advantageously, they can be variously set through programming features which will normally be set at the factory, but can be user-specified in the instance of retro-fit installations.

Using the embodiment shown schematically in FIG. 4, the boat operator can flush the engine 17 as described above. In addition, system 10 allows the operator to view the level of the protective material by looking at gauge display 32. Preferably, gauge display 32 is located on the console for easy viewing, or within another display, such as within the gauge showing the speed of boat 21 or rate of rotation of the crankshaft of engine 18. The operator can also verify that the protective material is being released into the cooling system by looking at a dispenser open indicator 46 that is typically placed in close proximity to gauge display 32.

The foregoing is provided for purposes of illustrating, explaining, and describing embodiments of this invention. Modifications and adaptations to these embodiments will be apparent to those skilled in the art and may be made without departing from the scope or spirit of this invention or the following claims.

What is claimed is:

1. A system for dispensing a protective material to a raw water passageway of a fluid-cooled engine, said system comprising:

a reservoir means for containing a protective material;

a dispensing means for controlling release of the reservoired protective material; and a connection means for coupling said reservoir means to a raw water passageway of a fluid-cooled engine at a location along the raw water passageway downstream of a raw water intake port of the fluid-cooled engine.

2. The system as set forth in claim 1, wherein said dispensing means comprises a valve.

3. The system as set forth in claim 1, further comprising an actuation device for opening and closing said dispensing means.

4. The system as set forth in claim 3, wherein said actuation device is a solenoid.

5. The system as set forth in claim 3, further comprising a switch for actuating said actuation device.

6. The system as set forth in claim 5, wherein said switch is a momentary switch.

7. The system as set forth in claim 5, further comprising a control unit for controlling dispensation of the protective material.

8. The system as set forth in claim 1, wherein said connection means comprises a fitting adapted for substantially permanent installation for establishing fluid communication with the raw water passageway of the fluid-cooled engine.

9. The system as set forth in claim 8, wherein said fitting is substantially T-shaped for accommodating in-line installation of said connection means with the raw water passageway of the fluid-cooled engine.

10. The system as set forth in claim 1, further comprises a protective material contained in said reservoir means, said protective material being an anticorrosive material.

11. The system as set forth in claim 1, further comprises a protective material contained in said reservoir means, said protective material comprises an antifreeze material.

12. The system as set forth in claim 1, further comprises a protective material contained in said reservoir means, said protective material being in a liquid state during said containment.

13. The system as set forth in claim 1, further comprises a protective material contained in said reservoir means, said protective material being in a solid state during said containment.

14. The system as set forth in claim 1, further comprising a gauge for displaying an amount of protective material contained within said reservoir means.

15. The system as set forth in claim 1, further comprising a pump for injecting the protective material into the raw water passageway of the fluid-cooled engine.

16. The system as set forth in claim 1, further comprising an attachment arrangement for mounting said reservoir means upon a carrying vehicle.

17. A system for dispensing a protective material to a raw water passageway of a fluid-cooled engine, said system comprising:

a reservoir that contains a protective material;

a dispenser that controls release of the reservoired protective material; and a connection device that fluidly couples said reservoir in-line with a raw water passageway of a fluid-cooled engine at a location along the raw water passageway downstream of a raw water intake port of the fluid-cooled engine.

18. The system as set forth in claim 17, further comprises a protective material contained in said reservoir means, said protective material comprises an antifreeze material.

19. The system as set forth in claim 17, further comprising an operator controlled, manual actuation device for opening and closing said dispenser.

20. The system as set forth in claim 19, wherein said operator controlled, manual actuation device requires continuous operator actuation to affect continuous dispensation of protective material.

21. The system as set forth in claim 17, further comprising a control unit that automates a controlled release of the protective material.

22. A marine vehicle having a raw water liquid-cooled engine, said vehicle comprising:

a raw water passageway for conveying raw water into association with a liquid-cooled engine that is carried upon the marine vehicle to absorb heat generated during operation of the liquid-cooled engine; and a protective system coupled in fluid communication with said raw water passageway of the liquid-cooled engine at a location along the raw water passageway downstream of a raw water intake port of the fluid-cooled engine, said protective system capable of delivering a protective material to the raw water passageway and said protective system further comprising a reservoir that contains a protective material and a dispenser that controls release of the reservoired protective material.

23. The marine vehicle as set forth in claim 22, wherein said protective system is fluidly coupled to a conduit comprising a portion of said raw water passageway positioned upstream from a water pump and downstream from raw water ports.

24. The marine vehicle as set forth in claim 23, wherein said raw water passageway forms an open loop raw water conveyance arranged in thermal communication with a closed loop conveyance that circulates cooling fluid about the engine.

25. The marine vehicle as set forth in claim 24, further comprising a heat exchanger that establishes said thermal communication and isolates raw water flowing in said open loop raw water conveyance from circulating cooling fluid flowing in said closed loop conveyance.

26. The marine vehicle as set forth in claim 22, further comprising a pump for injecting the protective material into the raw water passageway of a fluid-cooled engine.

27. The marine vehicle as set forth in claim 26, wherein said protective system is fluidly coupled to a conduit comprising a portion of said raw water passageway positioned downstream from a water pump located along said raw water passageway.

28. A method for delivering a protective material to a raw water passageway of a liquid-cooled engine, comprising:

running a liquid-cooled engine having a protective system coupled to the raw water passageway of the liquid-cooled engine at a location along the raw water passageway downstream of a raw water intake port of the fluid-cooled engine for delivering a protective material to the raw water passageway, said protective system further comprising a reservoir for containing a protective material and a dispenser for controlling release of the reservoired protective material;

actuating said dispenser causing the protective material to be released;

stopping the liquid-cooled engine after a predetermined time period has expired after actuation of said dispenser; and controlling the dispenser to stop release of the protective material.

29. The method as set forth in claim 28, wherein said predetermined time period is within a range between about fifteen seconds and about one minute.

30. The method as set forth in claim 28, wherein actuating said dispenser comprises actuating an actuation device coupled to said dispenser.

31. The method as set forth in claim 28, wherein actuating said dispenser comprises automated actuation by a control unit.

32. A marine vehicle having a raw water liquid-cooled engine, said vehicle comprising:

a raw water passageway for conveying raw water into association with a liquid-cooled engine that is carried upon the marine vehicle to absorb heat generated during operation of the liquid-cooled engine; and a protective system coupled in fluid communication with said raw water passageway of the liquid-cooled engine at a location along an in-line with the raw water passageway downstream of a raw water intake port of the fluid-cooled engine, said protective system configured to deliver a protective material to the raw water passageway during shut-down procedures.

* * * * *